US006592406B2

(12) United States Patent
Liu

(10) Patent No.: US 6,592,406 B2
(45) Date of Patent: Jul. 15, 2003

(54) ADAPTER WITH FUSE AND INDICATOR AND CAPABLE OF BEING USED AS PLUG

(76) Inventor: An-Hom Liu, 235 Chung-Ho Box 8-24, Taipei (TW)

( * ) Notice: Subject to any disclaimer, the term of this patent is extended or adjusted under 35 U.S.C. 154(b) by 89 days.

(21) Appl. No.: 09/897,649

(22) Filed: Jun. 28, 2001

(65) Prior Publication Data

US 2003/0003808 A1 Jan. 2, 2003

(51) Int. Cl.[7] ..... H01R 13/68

(52) U.S. Cl. ..... 439/622; 439/490; 439/172; 439/910

(58) Field of Search ..... 439/621, 622, 439/488, 490, 910, 131, 172

(56) References Cited

U.S. PATENT DOCUMENTS 4,758,184 A * 7/1988 Call ..... 439/622
5,482,478 A * 1/1996 Liao ..... 439/622
5,704,811 A * 1/1998 Hsu ..... 439/622
5,780,775 A * 7/1998 Yu ..... 439/910
5,810,622 A * 9/1998 Chang ..... 439/622
6,275,002 B1 * 8/2001 Chen ..... 439/131
6,290,533 B1 * 9/2001 Major ..... 439/490

* cited by examiner

*Primary Examiner*—Hien Vu

(57) ABSTRACT

An adapter with a fuse and an indicator and capable of being used as a plug is disclosed. The adapter mainly includes an upper cover and a lower cover. Two parallel male terminals and two parallel female terminals are installed in the upper cover and lower cover. An indicator is connected to the two parallel female terminals. By controlling the contact of the indicator with the female terminals, the user can know whether the electric device is working in normal condition. Other than arranging in a fixing way, the two male terminals are rotatable by connecting them to a rotary unit. Besides, connecting pieces are used to connect the male terminals and female terminals. Two connecting pieces are connected through a fuse. By the action of the fuse, as the current of the fuse is overloaded, the fuse will melt and break so that the connected electric devices are protected.

2 Claims, 5 Drawing Sheets

ADAPTER WITH FUSE AND INDICATOR AND CAPABLE OF BEING USED AS PLUG

FIELD OF THE INVENTION

The present invention relates to an adapter, and especially to an adapter with a fuse and an indicator and capable of using as a plug.

BACKGROUND OF THE INVENTION

With reference to FIGS. 1 and 2, a prior art plug is illustrated. The plug mainly has a casing 1. Two male terminals b and c, connecting wires d, and connecting holes e are installed in the casing 1. Another ends of the two parallel male terminals b, c are connected with two elastic pieces f and g so as to be formed as a receptacle. Although the connecting wires d, and connecting holes e are installed for removing electric static charges, but the receptacle and plug are extended from the two male terminals to another end of the casing a and then is coupled with preset elastic pieces f and g. Therefore, no safety device is installed between the receptacle and the plug. Also, no device may cause the user to know the condition of the electric devices. Therefore, as circuit is interrupted or the load of the current is over the burden of the circuit, or abnormality occurs, it is very possible that a dramatic accident such as fire accident may occurs. Therefore, the prior art structure is necessary to be improved.

SUMMARY OF THE INVENTION

Accordingly, the primary object of the present invention is to provide an adapter with a fuse and an indicator and capable of using as a plug.

To achieve above objects, the present invention provides an adapter with a fuse and an indicator and capable of being used as a plug. The adapter mainly includes an upper cover and a lower cover. Two parallel male terminals and two parallel female terminals are installed in the upper cover and lower cover. An indicator is connected to the two parallel female terminals. By controlling the contact of the positive and negative electrodes of the indicator with the two female terminals, the user can know whether the electric device is working in normal condition. Other than arranging in a fixing way, the two male terminals may have the function of rotation by connecting them to a rotary unit. Besides, connecting pieces are used to connect the male terminals and female terminals. At one side, two connecting pieces are connected through a fuse. By the action of the fuse, as the current of the fuse is overloaded, the fuse will melt and break so that the connected electric devices are protected and thus accident is avoided.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 3:
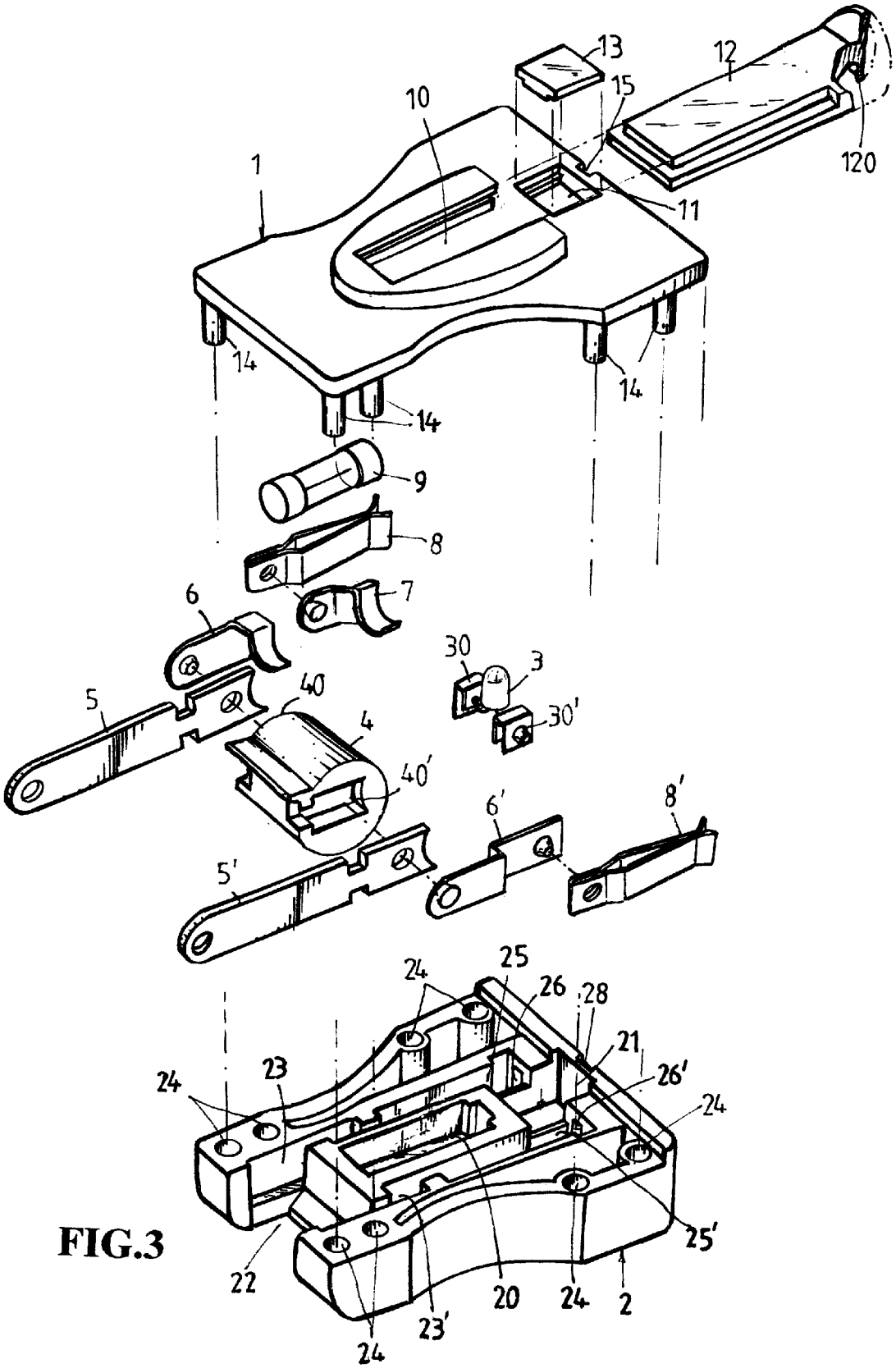
FIG. 3 is an exploded perspective view of the present invention.
Figure 4:
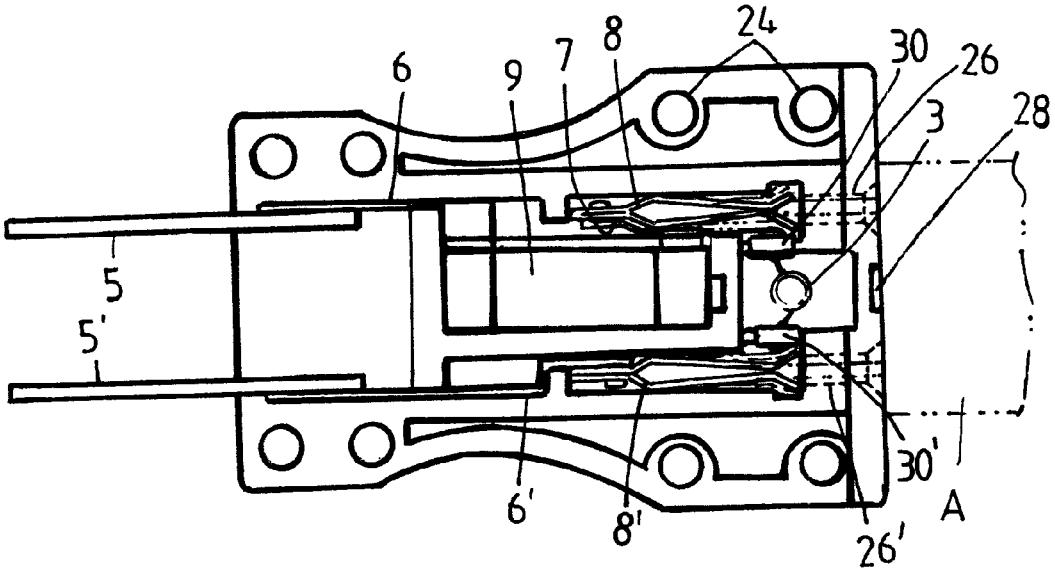
FIG. 4 is an assembled front view of the present invention.
Figure 5:
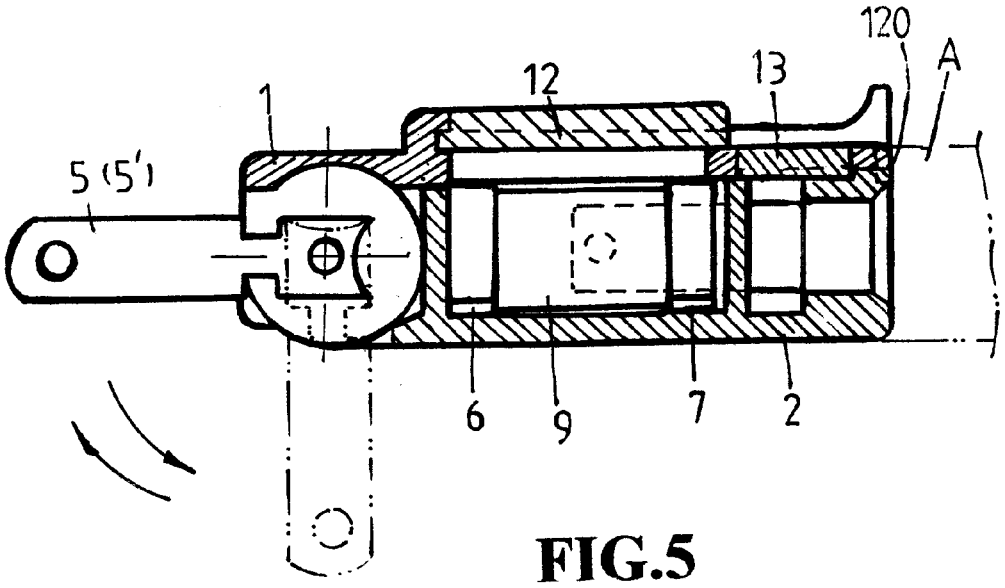
FIG. 5 is an assembled cross sectional view showing the operation of the present invention.

Referring to FIGS. 3 to 5, the adapter of the present invention is illustrated. The adapter of the present invention is mainly formed by an upper cover 1 and a lower cover 2.

The upper cover 1 has a shape having two larger ends and a thinner middle portion and is integrally formed by plastics. The upper cover 1 is installed with a fuse inlet hole 10, an indicator hole 11 and a notch 15. The fuse inlet hole 10 can be tightly sealed by a transparent cover 12. The lower block 120 of the transparent cover 12 is exactly buckled between the notch 15 and a notch 28 at the lower cover 2. When a plug A is inserted, it exactly resists against the transparent cover 12. The indicator hole 11 may be engaged with a transparent cover 13. The bottom of the upper cover 1 has a plurality of posts 14.

The lower cover 2 has a shape correspondent to the upper cover 1. The lower cover 2 is installed with a fuse receiving groove 20, an indicator receiving groove 21, an assembling grooves 24 and a notch 28 with respect to the fuse inlet hole 10, indicator hole 11, posts 14 and notch 15. A rotary unit receiving groove 22 is formed in front of the fuse receiving groove 20. The left and right sides of the rotary unit receiving groove 22 have connecting piece receiving grooves 23 and 23'. Two female terminal receiving grooves 25 and 25' extends from the connecting piece receiving grooves 23 and 23', respectively, from the left and right sides of the indicator receiving groove 21. The rear sides of the two female terminal receiving grooves 25 and 25' are connected to two receptacle holes 26 and 26', respectively. The indicator receiving groove 21 and the rotary unit receiving groove 22 are installed with an indicator 3 and a cylindrical rotary unit 4. The buckling grooves 40 and 40' at the left and right sides of the cylindrical rotary unit 4 are buckled to two male terminals 5 and 5', respectively, and then the rotary unit 4 is placed in the rotary unit receiving groove 22. The outer lateral surfaces of the two parallel male terminals 5 and 5' are buckled with respective connecting pieces 6 and 6'. Then the two connecting pieces 6 and 6' are connected with two female terminals 8 and 8', respectively so that the openings of the two female terminals 8 and 8' are exactly connected to respective receptacle holes 26 and 26', respectively. The male terminal 8 is connected to the fuse 9 through a connecting piece 7, as shown in FIGS. 4 and 5. By rotating the cylindrical rotary unit 4, the two male terminals 5 and 5' can rotate through a proper angle so as to be used conveniently. When the outer plug A is inserted into the receptacle holes 26 and 26', since the two female terminals 8 and 8' expand due to the insertion of the plug A, and thus, the female terminals 8 and 8' resist against a positive and a negative electrode 30 and 30' of the indicator 3. The circuit of the indicator 3 is formed as a loop for emitting light. Therefore, if only the plug A is not inserted well or abnormality occurs in the circuit or the 40 fuse 9 is broken, the circuit of the indicator 3 can not be formed as a loop so as not to emit light. Therefore, the indicator 3 has the functions of checking the plug A, fuse 9, circuits of connecting electric devices. Furthermore, through the fuse 9, as the current is over the tolerance of the fuse 9, the fuse 9 will melt. As a result, not only the electric devices are protected, but also the firing of electric wire is prevented.

Figure 6:
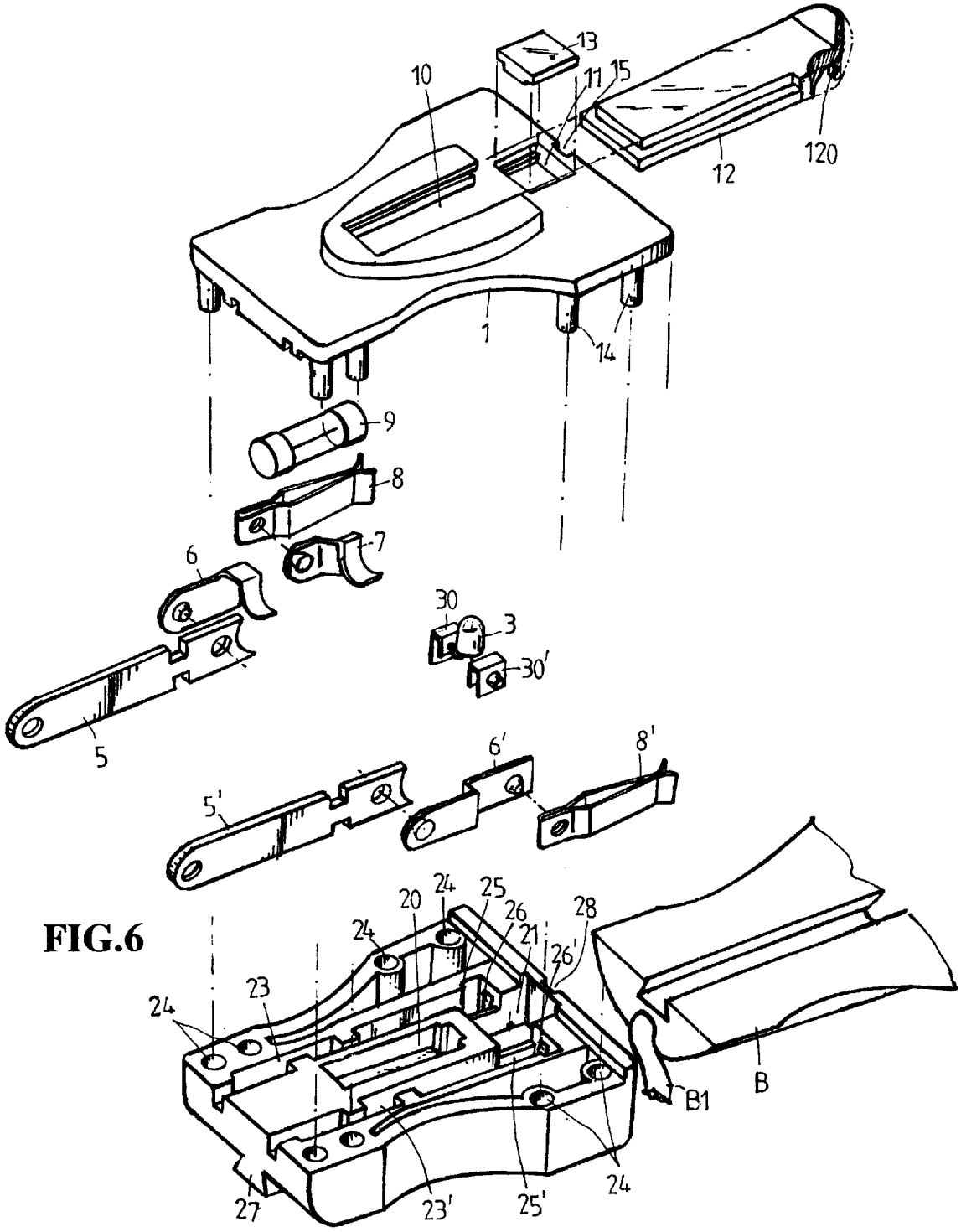
FIG. 6 is an exploded view of another embodiment in the present invention.
Figure 7:
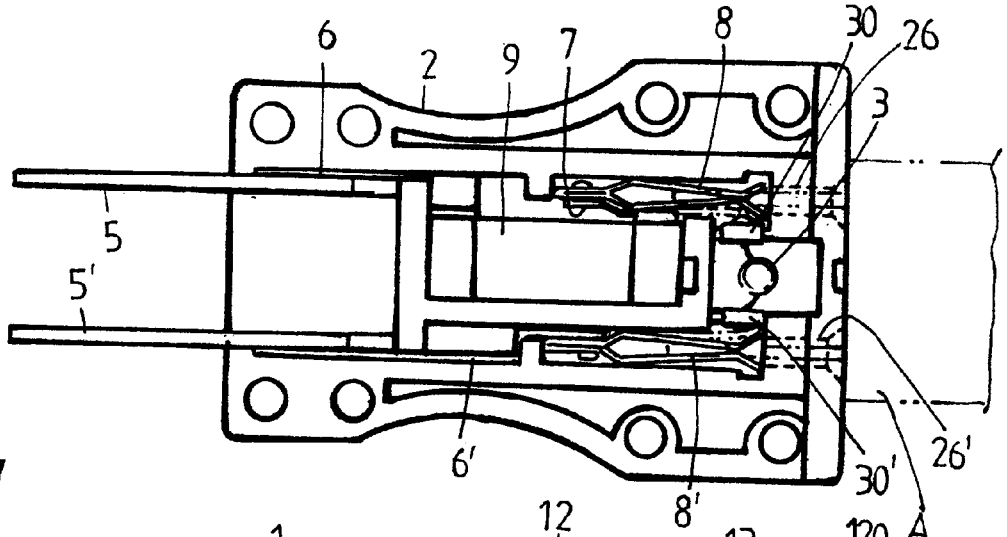
FIG. 7 is an assembled front view showing the structural feature of FIG. 6.
Figure 8:
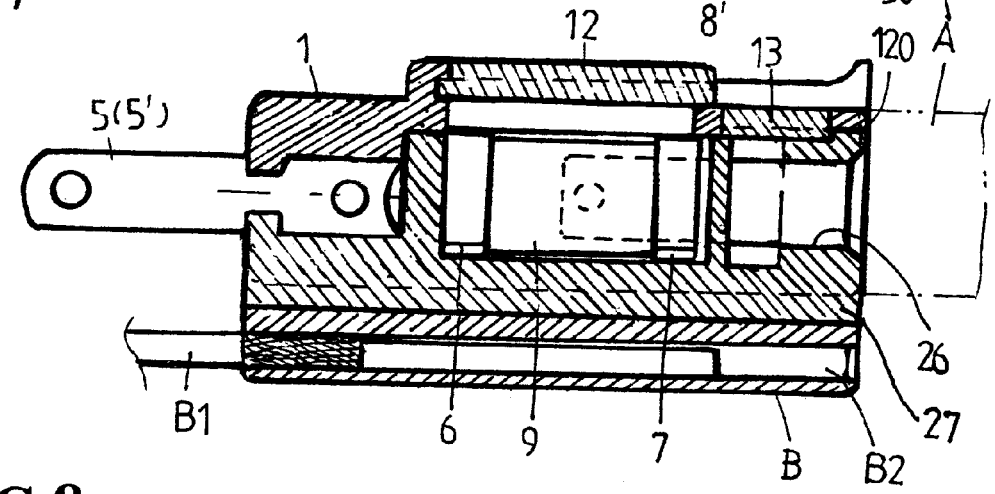
FIG. 8 is an assembled cross sectional view of the structural feature of FIG. 6.

Moreover, referring to FIGS. 6 to 8, the exploded view, assembled view, and front cross sectional view of another embodiment of the present invention are illustrated. From the figures, it is appreciated that other than structural feature, in the present invention, the two parallel male terminals 5 and 5' can be directly installed below the lower cover 2 so that the two male terminals 5 and 5' are fixed without rotation. Similarly, the two male terminals 5 and 5' are connected to the female terminals 8 and 8' through the connecting pieces 6 and 6', respectively. One female terminal 8 is connected to the fuse 9 through another connecting piece 7, while the indicator 3 is still installed in the indicator receiving groove 21, but not to contact with the two female terminals 8 and 8'. Besides, the bottom of the lower cover 2 is installed with an embedding strip 27. The embedding strip 27 is used to be embedded into a connecting body B. The connecting wires B1 and connecting holes B2 of the connecting body B are used to remove the electric static charges.

Figure 1:
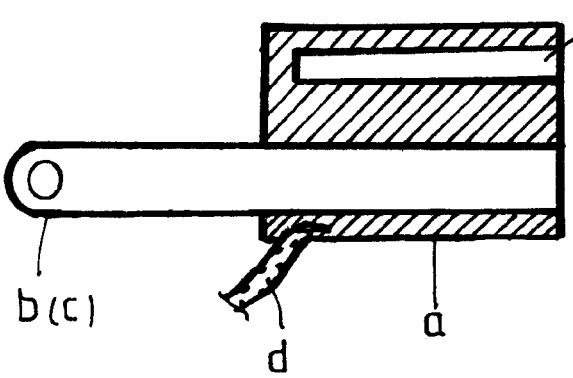
FIG. 1 is a cross sectional view of a prior adapter.
Figure 2:
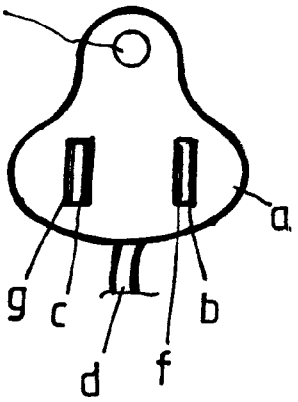
FIG. 2 shows a lateral view of a prior adapter.
Figure 9:
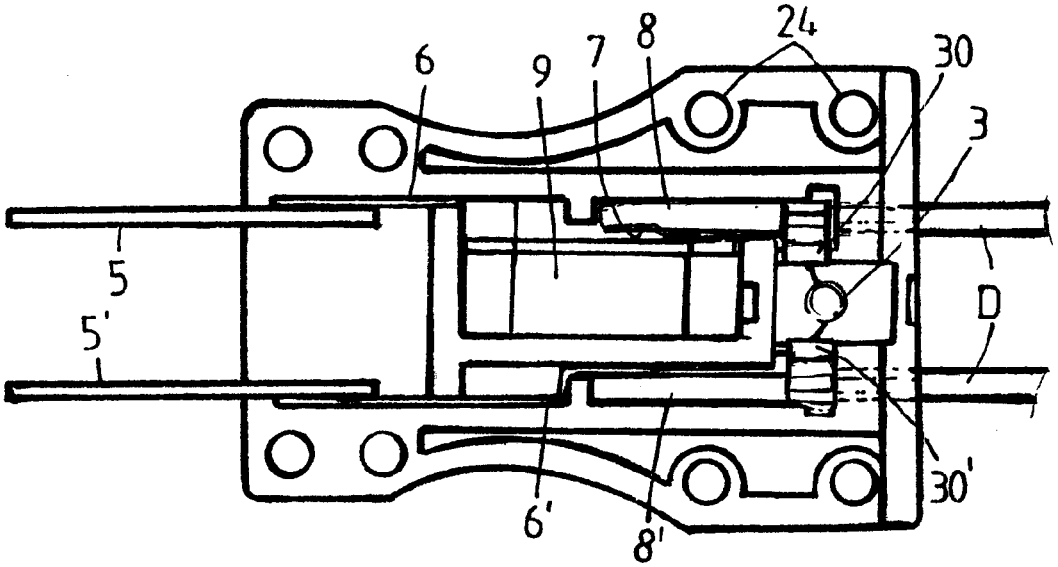
FIG. 9 is a structure schematic view of a further embodiment in the present invention.

From above structure, other than above embodiment, in the present invention, the two female terminals 8 and 8' can be designed as clamping heads for connecting with electric wires, as shown in FIG. 9 to form a plug so that the plug has the function of indicator and fuse.

The present invention are thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An adapter with a fuse and an indicator and capable of being used as a plug comprising:

an upper cover having a shape having two larger ends and a thinner middle portion and being intergrally formed by plastics; the upper cover being formed with a fuse inlet hole, an indicator hole and a first notch; the fuse inlet hole being tightly sealed by a first transparent cover; the first transparent cover having a lower block being exactly buckled between the first notch of the upper cover and a groove in the lower cover; when a plug being inserted into the adaptor, the lower block exactly resisting against the transparent cover; the indicator hole being engaged with a second transparent cover; a bottom of the upper cover having a plurality of posts;

a lower cover having a shape correspondent to the upper cover; the lower cover being installed with a fuse receiving groove configured with respect to the fuse inlet hole, an indicator receiving groove configured with respect to the indicator hole receiving an indicator, and a second notch configured with respect to the first notch; and a plurality of assembling holes configured with respect to respective posts; the lower cover further comprising:

a rotary unit receiving groove formed in front of the fuse receiving groove for receiving a cylindrical rotary unit;

a left and a right sides of the rotary unit receiving groove having respective connecting piece receiving grooves for receiving respective first connecting pieces;

two females terminal receiving grooves being extented from the connecting piece terminals for receiving two female (receiving grooves) respectively, from the left and right sides of the indicator receiving groove;

two receptacle holes at a rear side of the lower cover; rear sides of the two females terminal receiving grooves being connected to the two receptacle holes, respectively;

wherein buckling grooves at the left and right sides of the cylindrical rotary unit are buckled with two male terminals, respectively, and then the rotary unit buckling with the two male terminals is placed in the rotary unit receiving groove; outer lateral surfaces of the two parallel male terminals are buckled with respective two first connecting pieces; then the two first connecting pieces are connected with the two female terminals, respectively, thereby, the openings of the two female terminals being exactly connected to respective receptacle holes in the rear side of the lower cover;

one of the two male terminal is connected to the fuse through a second connecting piece; by rotating the cylindrical rotary unit, the two male terminals rotate through a predetermined angle; when a plug is inserted into the receptacle holes; since the two female terminals expand due to the insertion of the plug, the female terminals resists against a positive and a negative electrode of the indicator; thereby, an indicator circuit being formed as a loop for emitting light; and wherein the indicator has the functions of checking the plug, fuse circuits of connecting electric devices furthermore, through the fuse, as current is over tolerance of the fuse, the fuse will melt; as a result, not only the electric devices are protected, but also the firing of electric wire is prevented.

2. The adapter with a fuse and an indicator and capable of being using as a plug as claimed in claim 1, wherein each of the two female terminals is clip for clamping an electric wire, thereby, the adapter being formed as a plug.

* * * * *